US007398973B2

(12) United States Patent
Andrews

(10) Patent No.: US 7,398,973 B2
(45) Date of Patent: Jul. 15, 2008

(54) HOLD'EM POKER GAME AND DECK OF CARDS FOR PLAYING SAME

(76) Inventor: Chad Andrews, 1563 Lucretia Ave., Los Angeles, CA (US) 90026

( * ) Notice: Subject to any disclaimer, the term of this patent is extended or adjusted under 35 U.S.C. 154(b) by 32 days.

(21) Appl. No.: 11/160,881

(22) Filed: Jul. 14, 2005

(65) Prior Publication Data

US 2007/0013132 A1 Jan. 18, 2007

(51) Int. Cl.
*A63F 1/00* (2006.01)

(52) U.S. Cl. ..... 273/292; 273/304; 273/307

(58) Field of Classification Search ..... 273/274, 273/292, 303, 304, 306, 307; 463/13
See application file for complete search history.

(56) References Cited

U.S. PATENT DOCUMENTS 5,431,407 A * 7/1995 Hofberg et al. ..... 273/292
5,549,293 A * 8/1996 Seifert ..... 273/317.3
5,887,873 A * 3/1999 Freeman ..... 273/303
6,604,998 B1 * 8/2003 Singer et al. ..... 463/13
2003/0155716 A1 * 8/2003 Parker ..... 273/292
2005/0121853 A1 * 6/2005 Patelidas ..... 273/292

OTHER PUBLICATIONS http://en.wikipedia.org/wiki/Poker_probability_%28Texas_hold_%27em%29, website, May 2005.* http://www.launchpoker.com/texas-holdem/rules/, website, Oct. 2004.*

* cited by examiner

*Primary Examiner*—William M. Pierce
(74) *Attorney, Agent, or Firm*—Thompson Coburn LLP; Matthew A. Rosenberg, Esq.

(57) ABSTRACT

A variation of a poker game is shown, with a unique deck of cards. The deck inserts two additional values (11 and 12), and un-suits two values (10s and 11s). The play is substantially equivalent to that of Texas Hold 'Em except that the unsuited cards cannot be used to make flushes or straight flushes, and both hole cards must be used to make a straight, flush, or straight flush.

6 Claims, 4 Drawing Sheets

HOLD'EM POKER GAME AND DECK OF CARDS FOR PLAYING SAME

BACKGROUND OF THE INVENTION

1. Field of the Invention

The present invention relates generally to the game of poker, and more specifically to a new variation of a hold 'em style poker game.

2. Description of the Prior Art

Poker is a card game that has been around for nearly two hundred years in many variations, and is well-known throughout the world. Although some variations are more distinct than others, generally speaking, players wager on their own hands—the player with the highest ranking hand who participated in the last such wager, winning the wagered money of the other players. The ranking of the hands is based on collecting cards of matching value, a run of cards of consecutive values, and/or a set of cards of the same suit. Although some variations of the game involve different rankings of hands, it will be assumed that the general ranking of the hands (straight flush, four-of-a-kind, full house, flush, straight, three-of-a-kind, two pairs, one pair, high card only) is well known to those of ordinary skill in the art of poker, and will not be elaborated upon further.

Of the numerous variations of the game, there is a particular genre of the game, known as "hold 'em" games, which have become extremely popular in recent years. Hold 'em games involve some cards being dealt to each player ("hole cards"), and a series of community cards dealt on "the board," the latter belonging to all players. The object of hold 'em games is to make the best possible hand out of a combination of a player's hole cards and the community cards. The precise rules for the number of hole cards dealt to each player and how those cards may be combined with the community cards, differ with each hold 'em variation.

The most popular variation of hold 'em games is Texas Hold 'Em, which is currently the game with the largest purse at the World Series of Poker®. Texas Hold 'Em involves each player receiving two hole cards each. After an initial round of wagering, three community cards (known as "the flop") are dealt on the board, followed by another round of wagering. A fourth ("the turn") and a fifth ("the river") card are dealt on the board with the a round of wagering after each. Following the final round of wagering, the pot of collected wagers is awarded to the player with the highest ranking hand. A player's hand is determined by the best five-card poker hand that could be made using neither, either, or both of his hole cards together with an appropriate complement of board cards. Thus, if the board has a royal straight flush from the five community cards, then each player remaining will have the same exact hand regardless of his or her hole cards.

Texas Hold 'Em has major flaws with its inherent odds that often produce unfair results. A recent explosion in the popularity of poker has dramatically increased the number of amateur players competing in major games and tournaments. Numerous popular professionals have spoken out about the undesirable results produced in Texas Hold 'Em by the sheer volume of players who, through ignorance, do not act according to logic. One such professional, Daniel Negraneu, who was the 2004 Player of the Year, wrote that the prestige of the World Series of Poker has suffered for this exact reason.

Because of its odds, Texas Hold 'Em has an undesirable level of randomness. Whereas in an ideal game, the presence of ignorant play would lead to consistently profitable results for skilled players who capitalize on their strategic edge, the reality of Texas Hold 'Em is that in many situations the odds are too close between a player with a superior hand and one with a hand that is currently weak to dissuade the player with a weaker hand from making a bad decision to call when there are still community cards to be dealt; even when mathematics would dictate that folding is the most intelligent choice. When the player does call inappropriately, the odds of that player being rewarded by success are too considerable to be fair. This is especially true when more than one player calls illogically and compounds the chance that the superior hand of a skilled player will be caught. If three players each with only a 20% chance of winning a hand call against a player who has an 80% chance against any one of them, the combined chance of one of the three with 20% odds catching the precise card or cards needed to win is about 60% against the player with the dominant hand. In this case, the dominant hand becomes an underdog.

Proof that there are flaws in Texas Hold 'Em can be seen in the results of major tournaments in the 2005 World Series of Poker®. The final tables of events that featured Texas Hold 'Em where dominated by amateur players, whereas the final tables of other variations of poker such as Seven Card Stud and Omaha Hold 'Em, which do not suffer the same degree of inherent flaws, featured a much higher percentage of professionals at the final table. Increasingly as major Texas Hold 'Em poker games (and tournaments) are made more accessible to the masses, the professionals are catching more "bad beats" or situations where the odds dictated they should win, but they were caught on the turn or river by an inferior hand. Because of this, the top professionals are winning far less consistently in Texas Hold 'Em than when the entire field was largely comprised of skilled players. This is not true with other games.

Those who promote the game of poker, either for television ratings or in order to attract players to casinos, are vested in keeping poker at the highest levels accessible to the masses. However, the professionals, especially at this year's World Series of Poker®, advocated raising entry fees to discourage the kind of players who inject too much randomness into the game by calling when they ought to fold. A better solution is remedying Texas Hold 'Em to produce a more equitable result. Doing so appeals to both professionals who want fairness and those who wish to make poker accessible to anyone who wants to play. Thus, there is a need for variations to be introduced into Texas Hold 'Em to make it a more equitable game.

In game theory for poker, a skilled player makes decisions based upon the long-term success of that decision when weighed against various mathematical factors such as the odds of players having certain opposing hands, the odds of their own hand improving or maintaining its strength, and the size of the pot. There are many occasions in Texas Hold 'Em, especially, but not limited to smaller limit games and tournaments where players who rely on pure luck will have a chance to cripple a skilled opponent because the penalty for making bad calls is not sizable enough due to the relative odds. One major example is a flush draw. Even if an unskilled player makes a severely bad decision to match a large bet of a player with a made hand (and the size of the bet made by the person with the superior hand was strategically correct according to mathematical game theory), the inferior player will be rewarded for the mistake of a poor call nearly 40% of the time in Texas Hold 'Em. Other major mistakes are rewarded with similarly close odds. In Texas Hold 'Em, it is quite simply difficult for the skilled players to price poor players out of hands that they should not be involved with to begin with. The problem is compounded as multiple poor players call at the same time, further reducing the value of the made hand.

Another flaw in Texas Hold 'Em is that it encourages less skilled players to call with a straight draw or flush draw on the turn or the river, even when proper strategy based on pot odds (the mathematical expectation of what a player should win based on the amount in the pot, the cards he or she holds, and the number of remaining cards in the deck that will improve the hand) would dictate folding. Thus it is often difficult for more skilled players to price less skilled players out of a pot when the more skilled player has a significantly better hand. The less skilled player may then hit on the turn or the river, winning a pot they should never have been playing. Roughly 40% of the time the less skilled player will reap the benefit of his or her ignorant play.

Thus, there is a need for a variation of Texas Hold 'Em in which the outcome is based more on the skill of the player and less on the luck of the river card. It is, therefore, an object of the present invention to provide a new variation of Texas Hold ' Em that will fill this need.

It is a further object of the present invention to provide a unique deck of playing cards that will enable the creation of such a variation of Texas Hold 'Em.

SUMMARY OF THE INVENTION

It is with the above objects in mind that the present invention was developed. The present invention is a modified hold ' em poker game played with a unique deck of cards. The deck consists of 60 cards. There is a 2 through 9, plus a 12, a jack, queen, king, and ace of each of four suits. For purposes of this application, the fours suits will be designated as "C" (clubs), "D" (diamonds), "H" (hearts), and "S" (spades). The deck also has four unsuited 10's and four unsuited 11's.

The play is very similar to Texas Hold 'Em except that the aforementioned modified deck is used. This means that 10's and 11's may not be used to form flushes or straight flushes. The other difference in the present invention is that a straight or flush (or straight flush) must use both hole cards. It is insufficient for making a flush to have four suited cards on the board and a fifth in the hold (unless there is also a sixth suited card in the hole).

Thus the present invention provides much better odds for the better "made" hands to ultimately win the pot. Conversely, it naturally follows that is much more difficult in the present invention for hands to hit lucky draws on the turn or the river.

BRIEF DESCRIPTION OF THE DRAWINGS

So that the manner in which the above-identified features, advantages, and objects of the present invention are attained and can be understood in detail, a more particular description of the invention, briefly summarized above, may be had by reference to the embodiment thereof which is illustrated in the appended drawings.

It is noted however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE PREFERRED EMBODIMENT

The present invention is a poker game very similar to Texas Hold 'Em, with variations to improve fairness for skilled players. A unique deck of playing cards is used. The deck starts from a base of a conventional 52-card deck. Additional values are then inserted in the deck—preferably four 11's and four 12's, which obviously fit between the 10s and jacks of a conventional deck. One or more values are also considered unsuited, preferably the 10s and 11s. Because unsuited cards cannot be used to complete a flush or straight flush, the selection of 10 and 11 still permits a royal straight flush (12-J-Q-K-A).

Figure 1:
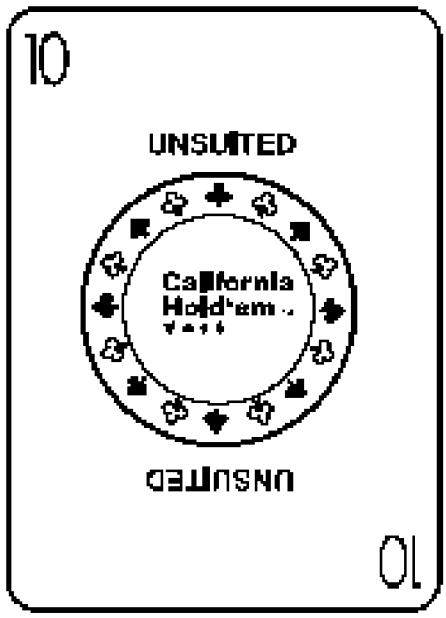
FIG. 1 shows an unsuited "10" card as used in the deck of playing cards of the present invention.
Figure 2:
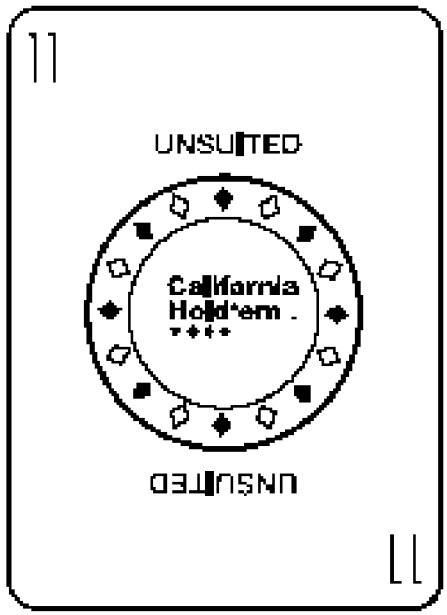
FIG. 2 shows an unsuited "11" card as used in the deck of playing cards of the present invention.
Figure 3:
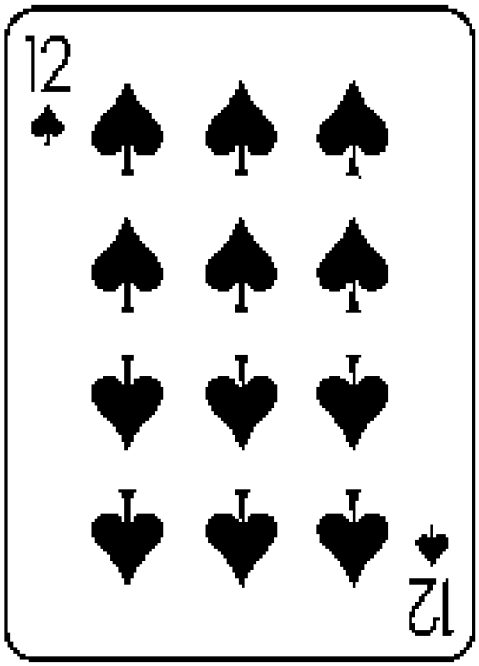
FIG. 3 shows a "12 of spades" as used in the deck of playing cards of the present invention.
Figure 4:
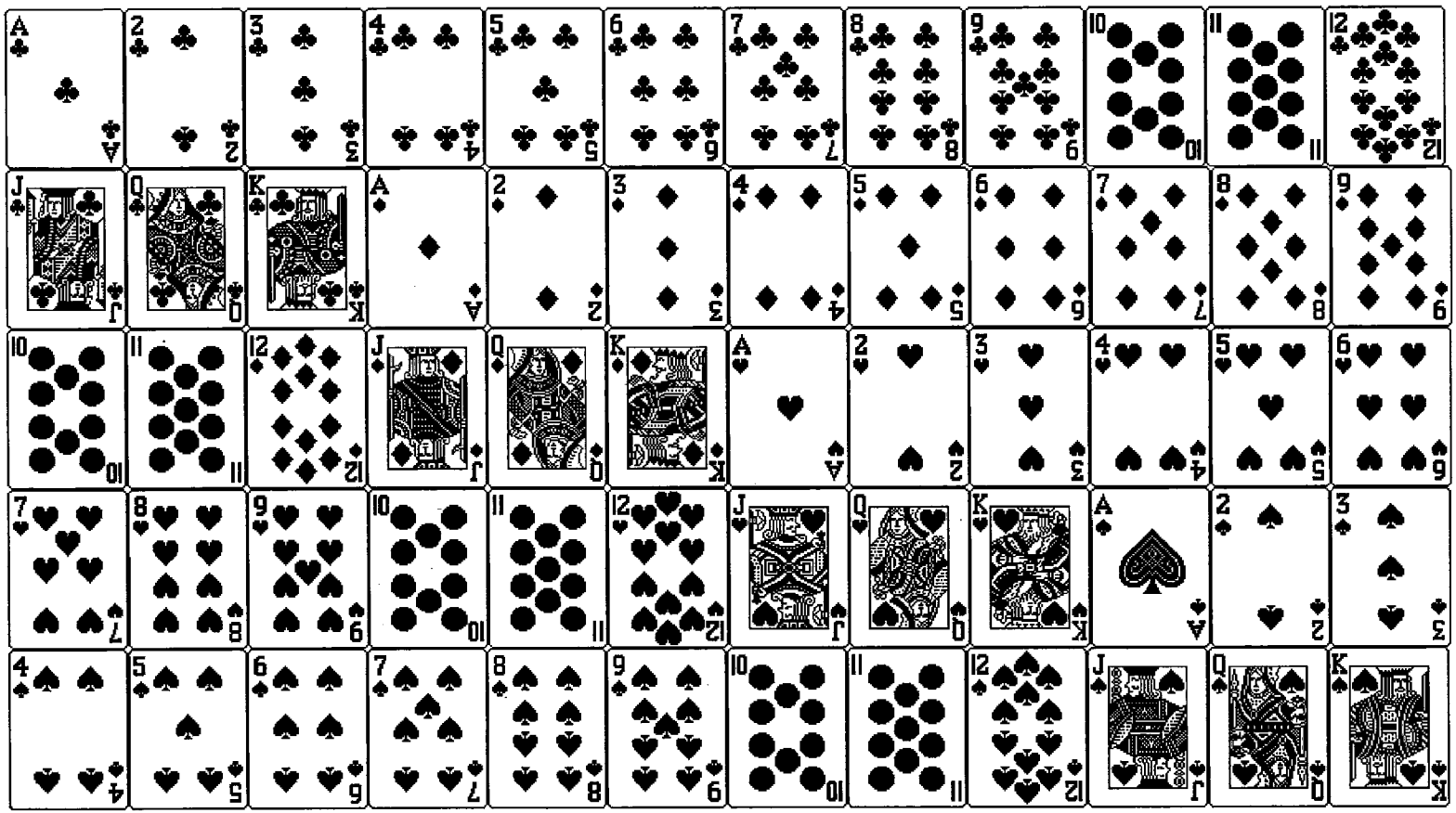
FIG. 4 shows an entire deck of playing cards according to the present invention.
Figure 5:
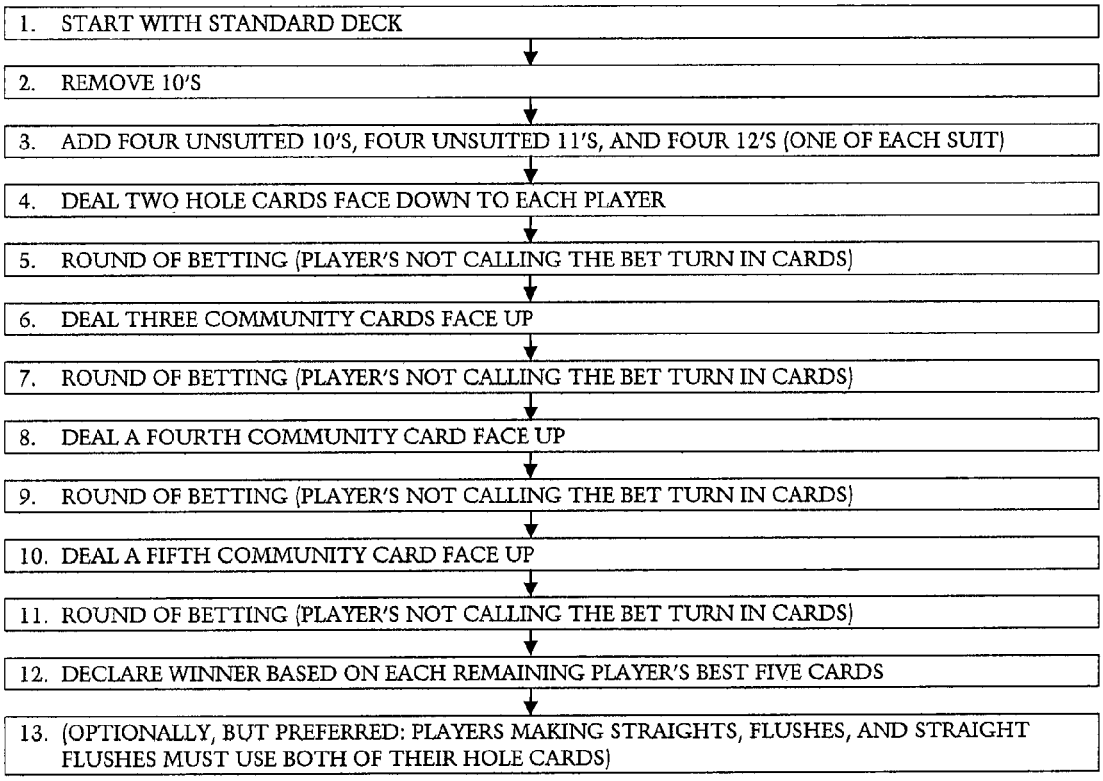
FIG. 5 shows the order of the method steps of the preferred embodiment of the invention.

FIGS. 1 and 2 show representations of the unsuited 10 and 11 respectively. These representations are the preferred form, although they can take any visual form provided it is clear that these cards are not available for suiting with a flush or straight flush (See, e.g., the design shown in FIG. 4). The depictions shown use no pips, and in place thereof a logo is used along with the word "UNSUITED." Optionally, the logo may incorporate a suit design for aesthetic purposes only. FIG. 3 shows a 12 of spades according to the deck of the present invention. Although, it is not necessary to use pips on the 12 cards, FIG. 3 shows one possible arrangement of 12 suit pips. A similar arrangement is shown in FIG. 4, which shows the entire deck of cards.

In the preferred embodiment play proceeds the same as in Texas Hold 'Em. Namely, each player is dealt two hole cards face down, followed by a round of betting. Three community cards—the flop—are then dealt face up on the board, followed by a subsequent round of betting. A fourth community card, and then the fifth (river) community cards are then dealt with a respective third and fourth round of betting after each.

Any betting scheme may be used, presuming it is compatible with other hold 'em games like Texas Hold 'Em. In any event, a player not calling a bet in any round must fold his cards and forfeit any money previously placed in the pot. At the end of the fourth round of betting, any players who have not folded vie for the pot by comparing hands. In the preferred embodiment, a player's hand consists of the best possible hand that can be made from his two hole cards and the five community cards, with the exception, preferably, that both hole cards must be used to make a straight, flush, or straight flush. Additionally, the unsuited cards are preferably not eligible for use in a flush or straight flush.

The requirement that both hole cards be used for straights, flushes, and straight flushes, is strongly preferred, because it helps fulfills the basic objective of the invention of making it difficult to improve a second-best hand. The other way this objective is fulfilled, is by excluding unsuited cards from flushes and straight flushes.

The aforementioned variations make it approximately 15% more difficult to improve an initial hand in the present invention as compared to the same hand in Texas Hold 'Em. What were "coin flip" situations in Texas Hold 'Em now favor the stronger hand played according to the rules of the preferred embodiment by approximately 15%. For instance, in Texas Hold 'Em, and initial deal of Q-Q is approximately 4% more likely to win than an initial deal of A-K (unsuited). In play according to the rules of the preferred embodiment, that same pair of queens are statistically significantly stronger.

The use of the unsuited cards also dramatically improves play over traditional Texas Hold 'Em. With two unsuited values (10 and 11), there are 13% fewer suited cards, thus there is a significant reduction in the chances for a player trying to catch a flush draw on the turn or the river. It thus follows that a skilled player with a made hand can now more easily dissuade a lesser skilled player from "fishing" for his flush or straight on the turn or the river.

As an example, suppose the board shows 9C-JS-7C-2C and two players have JH-JD and 8C-3H respectively. In conventional Texas Hold 'Em, the first player has three-of-a-kind already, and should be able to buy a small or moderately sized pot. However, the second player may decide to stay in, tempted by the straight draw and the flush draw-noting that this player should never have stayed in for the flop in the first place. That player has 11 "outs" in this hand in Texas Hold 'Em out of 44 cards (or a 25% of winning on the river). In the present invention, according to the preferred embodiment, the second player has "drawn dead" and has no chance of winning.

In a second example, suppose the board shows 5H-6D-JS-7H, and two players have AH-AS and 4H-9H respectively. In Texas Hold 'Em, the first player has had the much stronger hand all along, and again, the second player should probably not have called before or after the flop. In Texas Hold 'Em, the second player has 14 "outs" from 44 cards (or roughly a 32% chance of winning the hand). In the preferred embodiment of the present invention, that same player cannot make a straight and has only 8 "outs" (to make the flush) from 52 remaining cards (or about 15% chance of winning). Thus, it can be readily seen that the present invention favors players who play wisely and skillfully from before the flop.

Other variations of the preferred embodiment are possible, just as may be done with Texas Hold 'Em. For instance, betting may be limit (fixed stakes) based or no-limit based. The game can optionally be played hi-lo, where the best hand splits the pot with the worst hand. Betting incentives may be added by casinos, such as progressive jackpots for "bad-beat" hands (where the losing hand is of a pre-determined minimum ranking). The possibilities are endless without departing from the basic scope of the present invention. Furthermore, other values may be selected to be unsuited (e.g. 7 and 8).

While the foregoing is directed to the preferred embodiments of the present invention, other and future embodiments of the invention may be devised without departing from the basic scope thereof, and the scope thereof is determined by the claims which follow.

What is claimed is:

1. A method of playing a poker game among a plurality of players comprising the steps of:

providing a deck of playing cards, the cards having values of 2 through 9 and 12 through 15 and an ace in each of four suits, plus four unsuited cards having a value of 10 and four unsuited cards having a value of 11, the values of each card being located on a face thereof and each card having an identical back;

initially dealing two hole cards to each player in a manner so as not to expose the faces thereof to any other players;

subsequently dealing five community cards with the faces exposed to all players; and declaring a winner based on the best possible five-card poker hand made by each player from the seven cards consisting of his or her two hole cards and the five community cards.

2. The method of claim 1, further comprising the step of betting after the initial dealing step.

3. The method of claim 2, wherein the subsequent dealing step is performed by dealing the first three community cards immediately followed by a second round of betting, dealing a fourth community card immediately followed by a third round of betting, and dealing a fifth community card immediately followed by a final round of betting.

4. The method of claim 1, wherein the declaring step requires a player to use both of his or her hole cards if he or she is making a straight, flush, or straight flush.

5. The method of claim 1, wherein the cards with the value of 13 are designated as "jacks", the cards with the value of 14 are designated as "queens", and the cards with the value of 15 are designated as "kings".

6. A deck of playing cards comprising:

a base deck of 52 playing cards, each card having a unique combination of a value selected from a group of thirteen values and a suit selected from a group of four suits;

a plurality of additional cards, the number of such additional cards being a multiple of four and each card having a value distinct from the thirteen values of said base deck:

wherein there are exactly four additional cards of each value distinct from the thirteen values of said base deck; and wherein said additional cards are unsuited.

* * * * *